US008968081B2

(12) United States Patent
Paulsen

(10) Patent No.: US 8,968,081 B2
(45) **Date of Patent: *Mar. 3, 2015**

(54) METHODS AND APPARATUS FOR PROVIDING FOR DISPOSITION OF PROMOTIONAL OFFERS IN A WAGERING ENVIRONMENT

(71) Applicant: IGT, Las Vegas, NV (US)

(72) Inventor: Craig A. Paulsen, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/071,138

(22) Filed: Nov. 4, 2013

(65) Prior Publication Data

US 2014/0057707 A1 Feb. 27, 2014

Related U.S. Application Data

(63) Continuation of application No. 13/418,168, filed on Mar. 12, 2012, now Pat. No. 8,602,879, which is a continuation of application No. 12/417,988, filed on Apr. 3, 2009, now Pat. No. 8,157,642.

(51) Int. Cl.
*A63F 9/24* (2006.01)
*G07F 17/32* (2006.01)

(52) U.S. Cl.
CPC ..... *G07F 17/3255* (2013.01); *G07F 17/32* (2013.01)
USPC ..... 463/25

(58) Field of Classification Search
USPC ..... 463/25
See application file for complete search history.

(56) References Cited

U.S. PATENT DOCUMENTS

| | | | |
|---|---|---|---|
| 6,609,978 | B1 | 8/2003 | Paulsen |
| 6,993,494 | B1 | 1/2006 | Boushy et al. |
| 7,192,350 | B2 | 3/2007 | Nguyen |
| 2003/0078871 | A1 | 4/2003 | Webb |
| 2003/0216966 | A1 | 11/2003 | Saenz et al. |
| 2004/0024608 | A1 | 2/2004 | Saenz et al. |

(Continued)

FOREIGN PATENT DOCUMENTS

| | | |
|---|---|---|
| CA | 2488426 | 10/2003 |
| CA | 2488432 | 10/2003 |

(Continued)

OTHER PUBLICATIONS

Office Action for Chinese Patent Application No. 201080020689.4, dated Jul. 23, 2013 (7 pages).

(Continued)

*Primary Examiner* — Yu-Hsi D Sun
(74) *Attorney, Agent, or Firm* — Neal, Gerber & Eisenberg LLP

(57) ABSTRACT

Disclosed are data processing apparatus, systems, and methods implemented over a gaming network for providing for disposition of promotional offers in a wager-based gaming environment. A monitoring engine receives an identification of a promotional offer as having an unredeemed status. A determining engine determines that the promotional offer having the unredeemed status satisfies one or more parameters to designate the promotional offer for an auction. Such designation is independent of real-time wager-based game play in the gaming network. An auction control engine provides the designated promotional offer as an item to be auctioned in the wager-based gaming network.

20 Claims, 7 Drawing Sheets

(56) References Cited

U.S. PATENT DOCUMENTS

| | | | | |
|---|---|---|---|---|
| 2004/0097287 | A1 | 5/2004 | Postrel | |
| 2004/0143496 | A1 | 7/2004 | Saenz | |
| 2005/0027721 | A1 | 2/2005 | Saenz | |
| 2005/0171808 | A1 | 8/2005 | Saenz et al. | |
| 2005/0182647 | A1 | 8/2005 | Saenz et al. | |
| 2006/0234795 | A1 | 10/2006 | Dhunjishaw et al. | |
| 2006/0258446 | A1 | 11/2006 | Nguyen et al. | |
| 2007/0032286 | A1 | 2/2007 | Muir | |
| 2007/0207850 | A1 | 9/2007 | Darrah et al. | |
| 2009/0124351 | A1* | 5/2009 | DeWaal et al. | 463/25 |
| 2010/0130276 | A1* | 5/2010 | Fiden et al. | 463/16 |

FOREIGN PATENT DOCUMENTS

| | | |
|---|---|---|
| CA | 2486310 | 4/2005 |
| CA | 2514075 | 12/2005 |
| CN | 101218600 | 7/2008 |
| CN | 101232925 | 7/2008 |
| GB | 2 421 693 | 7/2006 |
| WO | WO 03/085483 | 10/2003 |
| WO | WO 03/085579 | 10/2003 |
| WO | WO 2006/005073 | 1/2006 |
| WO | WO 2006/039366 A2 | 4/2006 |
| WO | WO 2006/094153 | 9/2006 |
| WO | WO 2006/112893 A2 | 10/2006 |

OTHER PUBLICATIONS

English translation of Office Action for Chinese Patent Application No. 201080020689.4, dated Jul. 23, 2013 (7 pages).

James J. Hodl, "More Effect CRM" Casino Journal http://www.casinojournal.com/article.php?ids=2242 printed Mar. 3, 2008.

"Mariposa Selected for Use at the Flamingo Laughlin as Their Customer Relationship Management and Marketing Software Solution" CRM Today, Sep. 1, 2006. http://www.crm23day.com/news/crm/119646.php printed Mar. 3, 2008.

International Search and Written Opinion issued in Application No. PCT/US2010/028718.

Notice of Allowance and Allowability Notice with Examiner's Amendment dated Dec. 12, 2012 issued in U.S. Appl. No. 12/417,988.

Allowed Claims dated Dec. 12, 2012 issued in U.S. Appl. No. 12/417,988.

* cited by examiner

METHODS AND APPARATUS FOR PROVIDING FOR DISPOSITION OF PROMOTIONAL OFFERS IN A WAGERING ENVIRONMENT

PRIORITY CLAIM

This application is a continuation of, and claims priority to and the benefit of, U.S. patent application Ser. No. 13/418,168, filed on Mar. 12, 2012, which is a continuation of, and claims priority to and the benefit of, U.S. patent application Ser. No. 12/417,988, filed on Apr. 3, 2009, which issued as U.S. Pat. No. 8,157,642 on Apr. 17, 2012, the entire contents of each of which are incorporated herein by reference.

BACKGROUND OF THE INVENTION

The present application relates in general to gaming devices and systems and, in particular, to methods and apparatus for providing for disposition of items via gaming devices.

Casinos and other forms of gaming comprise a growing multi-billion dollar industry both domestically and abroad, with electronic and microprocessor based gaming machines being more popular than ever. Gaming machines may be placed in casinos, convenience stores, racetracks, supermarkets, bars and boats. Via a remote server, a gaming entity may provide gaming services in locale of a user's choosing, such as on a home computer or on a mobile device carried by the user.

Electronic and microprocessor based gaming machines can include various hardware and software components to provide a wide variety of game types and game playing capabilities, with such hardware and software components being generally well known in the art. For example, bill validators, coin acceptors, card readers, keypads, buttons, levers, touch screens, displays, coin hoppers, player tracking units and the like are examples of hardware that can be coupled to a gaming machine. Software components can include, for example, boot and initialization routines, various game play programs and subroutines, credit and payout routines, image and audio generation programs, security monitoring programs, authentication programs and a random number generator, among others.

The functions available on a gaming machine may depend on whether the gaming machine is linked to other gaming devices. For instance, when connected to other remote gaming devices, a gaming machine may provide progressive jackpots, player tracking and loyalty points programs, cashless gaming, and bonusing among other items. Many of these added components, features and programs can involve the implementation of various back-end and/or networked systems, including more hardware and software elements, as is generally known.

In a typical casino-based electronic gaming machine, such as a slot machine, video poker machine, video keno machine or the like, a game play is initiated through a wager of money or credit, whereupon the gaming machine determines a game outcome, presents the game outcome to the player and then potentially dispenses an award of some type, including a monetary award, depending upon the game outcome. In this instance, the gaming machine is operable to receive, store and dispense indicia of credit or cash as well as calculate a gaming outcome that could result in a large monetary award.

A gaming entity may provide gaming services to tens of thousands of users. For instance, a single land-based casino may include thousands of gaming machines. Player's gaming interests are constantly changing and the effort associated with providing fresh content to users is quite costly. The ability of a casino operator to maximize their operating profits and keep their customers happy is directly linked to their ability to provide new and desirable gaming content.

Thus, gaming device manufacturers are always looking for new and exciting ways to reward players and make gaming device play more entertaining. Awarding players with physical prizes in lieu of the cash equivalent is one game enhancement that certain players enjoy. For example, a casino may offer a new car as a prize or award instead of a traditional cash jackpot. The car may be placed on display in the casino in close proximity to the gaming machines which are capable of enabling players of those gaming machines to win the car. This attracts attention to these gaming machines.

One problem with this type of jackpot incentive is that certain players quickly become discouraged by the fact that that they have tried many times and are no closer to winning the prize than when they started. In other words, the money the player has invested in or wagered on the gaming machine does not help the player's odds on subsequent plays of the gaming machine. Therefore, a large investment or a large wager amount is not an encouragement to continue playing the gaming machine and can be a discouragement. In addition, because a casino may typically have only a few such gaming machines, players are given very little choice as to what prize they would like to pursue.

Another tool implemented by casino operators to keep players happy is customer relationship management (CRM) software. CRM services generally refers to the processes an organization uses to track and organize contacts with its current and prospective customers. CRM software and systems are used to support these processes; the software system can be accessed, and information about players and player interactions can be entered, stored and manipulated as desired. A general goal of implementing CRM services in a wagering environment is to improve services provided to players, and to use player information for targeted marketing.

Using CRM services, casinos and third-parties with which the casino has business relationships engage in marketing of their goods and services both to augment relationships with existing players/customers and to establish relationships with new customers. Thus, an effective CRM system in a wagering environment maintains a repository or database of player transaction history and information characterizing player demographics and purchasing trends, which could potentially be leveraged in developing effective marketing programs. Gaming CRM systems provide analytical, predictive, and management tools to promote customer retention. As part of a campaign, offers in the form of coupons and other comp items are made to players based on various criteria such as games played, player age, gender, rank, etc. These offers are targeted to attempt to provide the right offer to the right player at the right time.

The task of gleaning useful information from the often voluminous records of player activity maintained in CRM databases has proven to be difficult. Even when promotional campaigns are formulated using existing databases, the casino is often unable to readily estimate the effectiveness of the promotional campaign. Also, it has been difficult to discern changes in the behavior of various demographic groups of players, which hinders formulation of effective promotional campaigns. As a consequence, substantial marketing resources and the promotional offers themselves may be allocated ineffectively. This may lead to substantial waste, since such resources may then become directed to population groups in which a less than desirable fraction of the group's members are interested in the product or service being marketed.

Promotional offers are wasted when they are unused or under-utilized. When even a small percentage of issued promotional offers expire or are not redeemed, those offers add no value to the customers or to the casino. Due to the ongoing issues described above, the problem of under-utilization occurs regardless of whether the offers are made to players prior to visiting the casino, while they are in the casino, or later when they return home. Because promotional offers represent an expense to casinos and third party organizations, as well as an economic benefit to the customers, any yield less than 100% of issued promotional offers is undesirable.

SUMMARY OF THE DESCRIBED EMBODIMENTS

According to one aspect of the present invention, in a wager-based gaming network, a gaming system may comprise a number of host devices, for instance, in the form of servers, each coupled to one or more gaming machines. The gaming machines may be operable to provide wagering on an outcome of a game of chance, display the outcome of the game of chance, accept cash or an indicia of credit and dispense an award, such as cash or indicia of credit, to a player utilizing the gaming machine.

According to one aspect of the present invention, a data processing apparatus is coupled to the gaming network for providing for disposition of promotional offers in a wager-based gaming environment. A monitoring engine is coupled to receive an identification of a promotional offer associated with a customer relationship management program in the wager-based gaming network as having an unredeemed status. A determining engine is coupled to determine that the promotional offer having the unredeemed status has one or more attributes satisfying one or more parameters to designate the promotional offer for an auction, the designation being independent of real-time wager-based game play in the gaming network. An auction control engine is coupled to provide the designated promotional offer as an item to be auctioned in the wager-based gaming network. An auction resolution engine is coupled to generate a report including data indicating results of the auction. The report is capable of being output to provide the auction results data as a part of customer relationship management data maintained by the customer relationship management program in the wager-based gaming network.

In one implementation, the one or more parameters can include items such as a time before an event associated with the promotional offer, a status of an event associated with the promotional offer, an expiration time for the promotional offer, a number or percentage of issued promotional offers having an unredeemed status, and/or a value of the promotional offer. In one embodiment, the one or more parameters can include an identification of a source of the promotional offer, such as a casino operator, a third party provider, or a collaboration of a casino operator and a third party provider.

In one implementation, determining that the promotional offer having the unredeemed status has one or more attributes satisfying one or more parameters includes calculating a weighted combination of the satisfied one or more parameters.

In one implementation, the determining engine is further coupled to: determine a type of the auction based on the one or more attributes, determine one or more characteristics of the auction based on the one or more attributes, and/or identify one or more participants for the auction based on information associated with the one or more participants.

According to another aspect of the present invention, a system provides for disposition of promotional offers in a wager-based gaming environment. A customer relationship management server is coupled to the wager-based gaming network. The customer relationship management server is configured to maintain customer relationship management data for players participating in a customer relationship management program in the wager-based gaming environment. A data processing apparatus is coupled to the wager-based gaming network. The data processing apparatus includes a monitoring engine coupled to receive an identification of a promotional offer associated with the customer relationship management program as having an unredeemed status, a determining engine coupled to determine that the promotional offer having the unredeemed status has one or more attributes satisfying one or more parameters to designate the promotional offer for an auction, the designation being independent of real-time wager-based game play in the gaming network, an auction control engine coupled to provide the designated promotional offer as an item to be auctioned in the wager-based gaming network, and an auction resolution engine coupled to generate a report including data indicating results of the auction, the report capable of being provided to the customer relationship management server for providing the auction results data as a part of the customer relationship management data maintained by the customer relationship management program in the wager-based gaming network.

In one implementation, the system further comprises a device including a processor configured to generate a graphical display of wagering stations on a floor map of a gaming environment, and a display configured to display the graphical display. For instance, the display can be associated with a player tracking device. The device can take a variety of forms, such as a gaming machine, a kiosk, a portable handheld device, a mobile phone, or a computer. The graphical display can include information identifying bidding activity at the wagering stations. In one implementation, the system further comprises a device configured to generate a graphical user interface for participation in an auction. The device can take a variety of forms, such as a gaming machine, a table game interface, a kiosk, a portable handheld device, a mobile phone, or a computer. Such devices can be in communication with the wager-based gaming network via a wired interface or a wireless interface. The device preferably has an interface configured to receive and send communications of one or more formats such as email, instant messaging, website notifications, blog postings, and phone calls.

According to another aspect of the present invention, a method is provided for disposition of promotional offers in a wagering environment. An identification of a promotional offer associated with a customer relationship management (CRM) program as having an unredeemed status is received. It can then be determined that the promotional offer having the unredeemed status has one or more attributes satisfying one or more parameters to designate the promotional offer for an auction, the designation being independent of real-time game play. The designated promotional offer can be provided as an item to be auctioned.

In one implementation, the method further includes determining a time to initiate an auction for the promotional offer, initiating an auction for the promotional offer, and receiving credit as payment for the item. For instance, the credit can include points in a rewards program. Initiating the auction can include receiving an indication of occurrence of an auction trigger event, such as occurrence of a bonus event, occurrence of a game play event, or identification of a time preceding a promotional event as within a threshold. The auction trigger event can also include one or more items such as occurrence of a mystery auction, an amount of coin-in, an amount of credit-in, a bet size, a bet speed, a season, a month, a time, a type of game, a type of gaming device operated by a player, and a loyalty club status of a player.

In one implementation, the method further includes identifying one or more participants for the auction based on information associated with the one or more participants. A message can be sent notifying the identified one or more participants of the auction, the message associated with a subscription service. The information associated with the one or more participants can include customer relationship management (CRM) information, player tracking information, player loyalty club status, player preference information, information identifying one or more gaming machines used by the participants, geographic location information associated with the one or more participants, network location information associated with the one or more participants, and/or demographic information associated with the one or more participants. Such information can also include a request message from the one or more participants.

In one implementation, the method can include providing information related to the auction to a storage medium storing customer relationship management (CRM) information. The method can also include generating a graphical display of a wagering stations on a floor map of a gaming environment, and displaying the graphical display on a display associated with a data processing device. The wagering stations can take various forms, including a gaming machine, a kiosk, a portable handheld device, a mobile phone, and a computer. In addition, the method can include the steps of generating an image of a virtual host associated with an auction, and displaying the image on a display associated with a data processing device. Also, a further promotional offer can be provided with the promotional offer to be auctioned.

Another aspect of the invention pertains to computer program products including a machine-readable medium on which are stored program instructions for implementing any of the methods described above. Any of the methods of this invention may be represented as program instructions and/or data structures, databases, etc. that can be provided on such computer readable media.

Aspects of the invention may be implemented by networked gaming machines, game servers and other such devices. These and other features and benefits of aspects of the invention will be described in more detail below with reference to the associated drawings. In addition, other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE DRAWINGS

The included drawings are for illustrative purposes and serve only to provide examples of possible structures and process steps for the disclosed inventive methods, apparatus, and systems. These drawings in no way limit any changes in form and detail that may be made to the invention by one skilled in the art without departing from the spirit and scope of the present invention.

DETAILED DESCRIPTION OF SPECIFIC EMBODIMENTS

Figure 1:
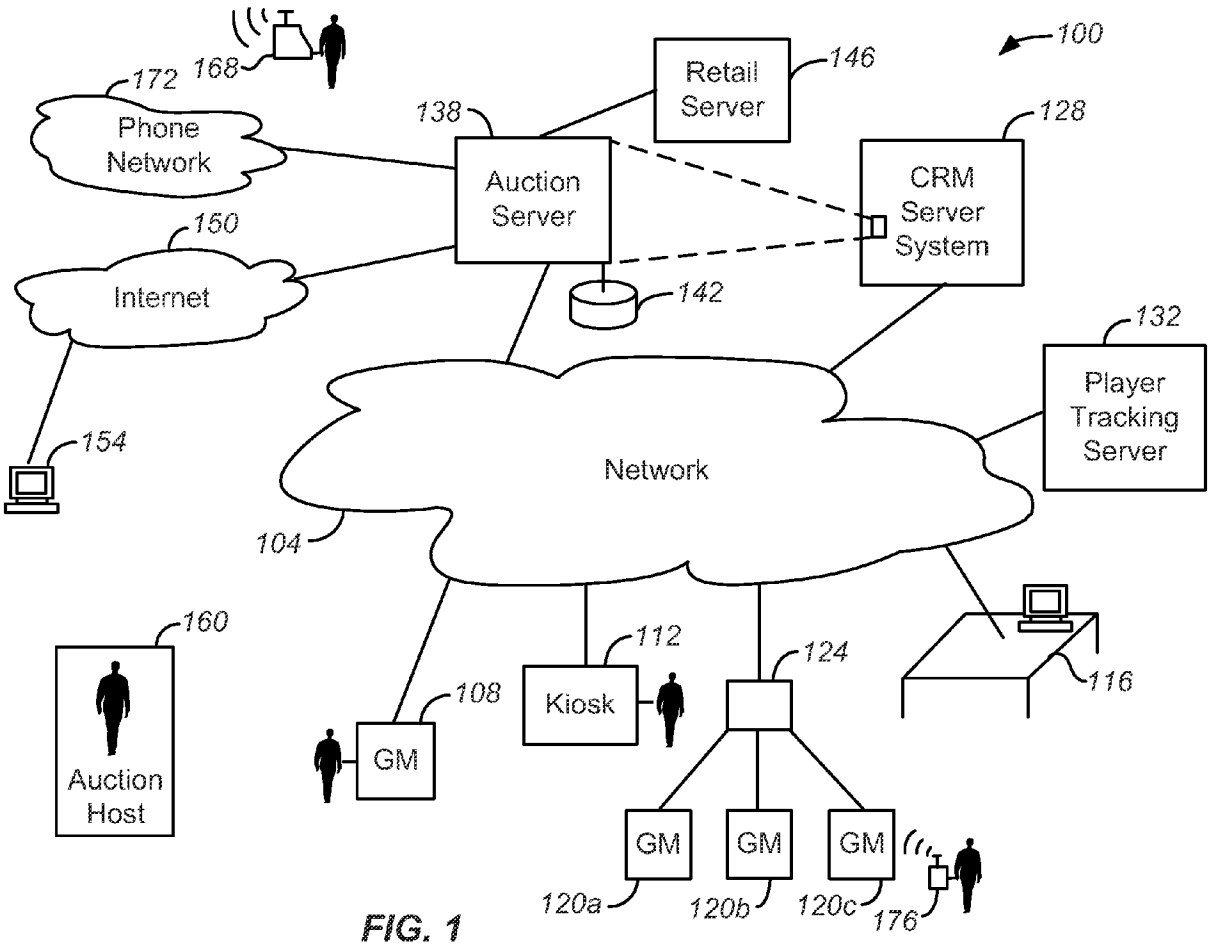
FIG. 1 shows a system 100 implementing methods and apparatus for providing for disposition of promotional offers in a wagering environment, constructed in accordance with one embodiment of the present invention.

Exemplary applications of systems and methods according to the present invention are described in this section. These examples are being provided solely to add context and aid in the understanding of the present invention. It will thus be apparent to one skilled in the art that the invention may be practiced without some or all of these specific details. In other instances, well known process steps have not been described in detail in order to avoid unnecessarily obscuring the present invention. Other applications are possible, such that the following example should not be taken as definitive or limiting either in scope or setting.

In the following detailed description, references are made to the accompanying drawings, which form a part of the description and in which are shown, by way of illustration, specific embodiments of the present invention. Although these embodiments are described in sufficient detail to enable one skilled in the art to practice the invention, it is understood that these examples are not limiting, such that other embodiments may be used and changes may be made without departing from the spirit and scope of the invention.

Although the present invention is directed primarily to gaming machines and systems, it is worth noting that some of the apparatuses, systems and methods disclosed herein might be adaptable for use in other types of devices, systems or environments, as applicable, such that their use is not restricted exclusively to gaming machines and contexts. Such other adaptations may become readily apparent upon review of the inventive apparatuses, systems and methods illustrated and discussed herein.

In the following figures, method and apparatus applicable to various gaming system configurations and their associated components are described. The gaming systems may comprise a network infrastructure for enabling one or more hosts to communicate with gaming machines. The gaming machines may be operable to provide wagering on a game of chance. A plurality of gaming devices, such as bill/ticket validators, printers, mechanical displays, video displays, coin hoppers, light panels, input buttons, touch screens, key pads, card readers, audio output devices, etc., may be coupled to the gaming machine. The gaming devices may be controlled by a master gaming controller executing authenticated software to provide a gaming interface for a game play experience on the gaming machine.

Embodiments of the present invention implement methods, apparatus, and systems to provide improved yield management of promotional offers issued by casino operators and/or third party providers. Applying principles of the present invention, the percentage of issued promotional offers that are redeemed and used is improved, providing increased value to casinos, third parties, and the customers. In some embodiments, the yield is effectively improved by providing an auction of unutilized or underutilized promotional offers to players in a wagering environment. The offers can be provided directly or indirectly from different sources including various third-parties, casinos, and combinations thereof. Embodiments of the present invention leverage various resources to enhance utilization of the promotional offers.

In one example, promotional offers, e.g., in the form of tickets to a casino show, have been distributed to players identified using a customer relationship management (CRM) system. As showtime approaches, there are seats remaining after exhausting traditional delivery methods. The system identifies that a number of tickets distributed as part of the promotion are unredeemed. Aspects of the present invention enable a real-time auction of the unredeemed show tickets before they expire. The auction can be triggered and structured using a variety of parameters and conditions. Selected players are allowed to bid for the auctioned items at various devices, such as gaming machines, casino kiosks, mobile devices, and personal computers via the Internet. The auction can be opened up to various groups and sub-groups and, in one example, virtually anyone in the general public.

Using various techniques described herein, the promotional offers can successfully be auctioned off before the event. In the example of the casino show, more revenue is generated by selling/auctioning the tickets, the casino and interested third parties achieve the various benefits associated with promotional offer distribution, players experience the excitement of a real-time auction, and the winning player experiences the thrill of winning an auction for tickets to attend the show.

FIG. 1 shows a system 100 implementing methods and apparatus for providing for disposition of promotional offers in a wagering environment, in accordance with embodiments of the present invention. The system includes a gaming network 104, which can be implemented within a single gaming environment such as a casino or across multiple casinos or properties. In communication with gaming network 104 are various gaming apparatus, including, in this example, a gaming machine 108, a kiosk 112, a table game processing apparatus 116, and a bank of gaming machines 120*a-c* served by a controller 124 in communication with gaming network 104.

In FIG. 1, a customer relationship management (CRM) server system 128 is in communication with gaming network 104. CRM systems have been implemented in wagering environments such as casinos and are described, for example, in Saenz et al., U.S. patent application Ser. No. 10/406,578, titled "INFORMATION PROCESSING SYSTEM FOR TARGETED MARKETING AND CUSTOMER RELATIONSHIP MANAGEMENT," filed Apr. 3, 2003, which is hereby incorporated by reference in its entirety for all purposes. In one embodiment, CRM server system 128 is primarily responsible for issuing promotional offers to casino patrons, identifying groups and classifications of patrons to receive the offers, and tracking the redemption of the offers. While the auction server 138 can be implemented as a separate data processing device/server, bidding activity information gathered by auction server 138 can be delivered back to CRM system 128 for integration with other promotional offers and player data maintained therein.

Promotional offers can be issued not only by a casino operator, but also from third party sources such as a retailer 146, hotels, stores, malls, and other vendors. In another embodiment, promotional offers are issued by a combination of one or more casinos and/or third parties. For instance, a car rental company and a casino can collaborate in a joint marketing campaign to provide a joint promotional offer. Promotional offers can take a variety of forms such as tickets, coupons, discounts, free meals, magazine subscriptions, and free bonus plays. As used herein, promotional offers can refer to any type of offer that has value. For example, retail server 146 can be configured to provide information to auction server regarding the distribution and status of promotional offers provided by one or more retailers or vendors. This way, as further described herein, auction server 138 can implement auctions of promotional offers from such third parties. One of the benefits of interfacing with a retail server in this manner, for example, is that offers may be presented to the player that aren't necessarily casino-related, such as airline discounts or car rentals. This provides co-branding opportunities and an additional revenue source to the casino from third parties.

In FIG. 1, a player tracking server 132 is also in communication with gaming network 104. Depending on the desired implementation, player tracking services and operations of player tracking server 132 can be implemented as a server or suitable data processing unit within CRM server system 128 or as a separate unit, as illustrated in FIG. 1.

In FIG. 1, an auction server 138 is also in communication with gaming network 104. Auction server 138 includes suitable data processing apparatus configured to implement methods and apparatus for providing auctions for promotional offers, in accordance with embodiments of the invention. Auction server 138 is in communication with an auction database 142, in which auction-related information described herein is stored. Such auction information can be accessed and retrieved as needed by auction server 138 to carry out methods and operations as described herein. In one embodiment, the auction database 142 is a dedicated storage medium maintained for storing information related to auction items and proposed terms of sale for them.

In FIG. 1, auction server 138 can be in communication with player tracking server 132 via a direct communications link or via network 104, depending on the desired implementation, to access and make determinations based on player tracking information. Auction server 138 can also be in communication with third-party auction sites and offer/prize fulfillment systems separate and apart from CRM system 128. For example, in one implementation, on-site or off-site clearinghouses for auction items are maintained and monitored as part of the operations of auction server 138 described herein.

In FIG. 1, in one embodiment, auction server 138 has a suitable interface to connect to an open public network such as the Internet 150. In this way, a potential player accessing a personal computer 154 at a location such as the player's home or a hotel, can participate in an auction as described herein without having to visit a gaming property. In one embodiment, the auction system 100 provides for proxy bidders as designated stand-in bidders or virtual agents for auction participants at such remote locations.

In FIG. 1, a person serving as an auction host 160 can be situated in the gaming environment, for instance, on a casino floor, to either run an auction as an auctioneer or participate in the auction as a cheerleader for one or more players participating in the auction. For instance, responsive to identifying one or more players in proximity to the auction host 160, and in some embodiments, using additional information such as player rank, highest bid, and player status in a casino loyalty program, the auction host 160 can be summoned to one or more players' machines to encourage the player. For instance, at the beginning of an auction, the live host could be notified of the location of a player meeting certain criteria, and then walk to the player's machine to talk with and encourage the player. In another example, the live host 160 could be summoned to a winning player's machine at the end of an auction to present the promotional offer to and congratulate the player, again encouraging player excitement and interest to participate in further auctions.

In another embodiment, a virtual host, providing some of the above-described features of the auction host 160, is provided in accordance with embodiments of the present invention. In this embodiment, a computer-generated animation or a video image of a person at a remote location, serving as the auction host 160, is displayed in a window or suitable region of an interface displayed on the player's data processing device. In the animation embodiment, a graphical representation, such as an animated character, can be generated on the player's interface to respond to player input and otherwise interact with the player during the auction. In the remote operator embodiment, a remote "call center" can be implemented in which a number of people are serving as operators, any one of which can interact with the player. Streaming video images and audio can be relayed back and forth between the player's machine and the remote server or call center, depending on the desired implementation, so the player can interact with the remote virtual host in substantially real-time.

In FIG. 1, players are provided with suitable interfaces to participate in an auction at various gaming apparatus inside or outside a gaming environment such as a casino. For instance, a graphical user interface, as described herein, can be generated and displayed on gaming machine 108, kiosk 112, any of gaming machines 120*a-c*, table game processing apparatus 116, and personal computer 154. In another example, a player can use a portable handheld device such as a personal digital assistant (PDA) or a cell phone 168 to either communicate directly with auction server 138 or with a gaming device as an intermediary to interact with auction server 138. A suitable user interface as described herein can be displayed on any such devices. In the example of the cell phone 168, in one embodiment, the player can communicate with auction server 138 through one or several phone networks 172 with which auction server 138 is in communication.

In FIG. 1, a player carrying a portable handheld device 176 such as a personal digital assistant (PDA) is able to interact via a wireless interface with gaming machines in the gaming environment and, in some embodiments, with gaming network 104. The portable handheld device 176 can communicate directly with gaming network 104 or indirectly with network 104 via a secure interface with phone network 172, for example, when the handheld device 176 is implemented as a cell phone. In such implementations, the portable handheld device 176 can provide wireless game play for the player, in which gaming sessions can be played by the player regardless of the player's geographic location. Thus, methods and apparatus of embodiments of the present invention can be implemented on such portable handheld devices 176, including the generation and display of, and interaction with, user interfaces as described herein and illustrated in the various FIGs. In this way, players can participate in the management and auction of promotional offers, as described herein, as they travel from place to place.

Figure 2:
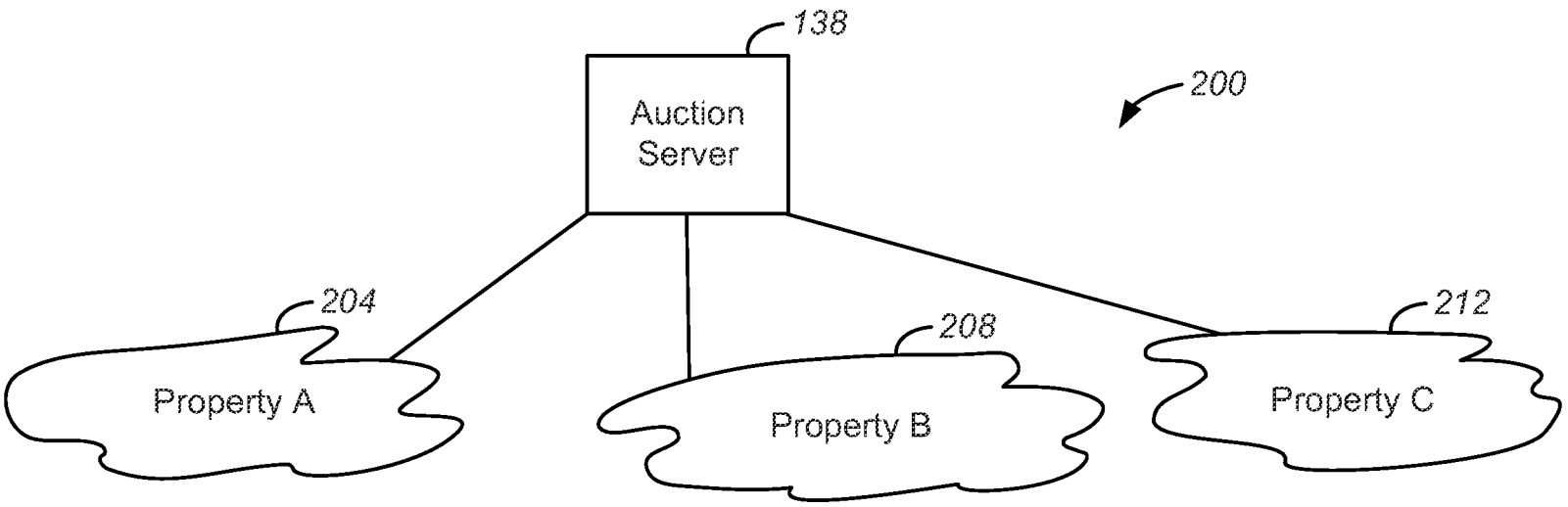
FIG. 2 shows a system 200 for implementing methods and apparatus for providing for disposition of promotional offers, constructed in accordance with one embodiment of the present invention.

FIG. 2 shows an alternative implementation of a system 200 for implementing methods and apparatus for providing for disposition of promotional offers, in accordance with embodiments of the present invention. In FIG. 2, the system 200 includes auction server 138, as described above, which is in communication with several gaming networks serving different gaming properties, such as, casinos, hotels, airports, and other gaming facilities. In FIG. 2, a network 204 serves property A, a network 208 serves property B, and a network 212 serves property C. In this way, auction server 138 is able to identify promotional offers from one property, and when desired by the property managers/casino operators, auction promotional offers in one property to players located in other properties. As mentioned above, such promotional offers can also be offered to players located outside all of the gaming properties 204-212, for instance, located at home and communicating with the auction server 138 over the Internet 150.

FIG. 2 illustrates an embodiment in which third party vendors and gaming properties such as casinos could be networked to enhance yield management of resources. For example, if one casino's show is filled, a player can be directed to another casino which has available seats. In such situations, preferably marketing and resource sharing agreements are implemented between properties to facilitate the sharing of promotional offers. Communications channels are established between gaming property managers, e.g., over networks described herein, to transmit time-sensitive information regarding the status of promotional offers and requests to auction items at a different gaming property or other location.

Figure 3:
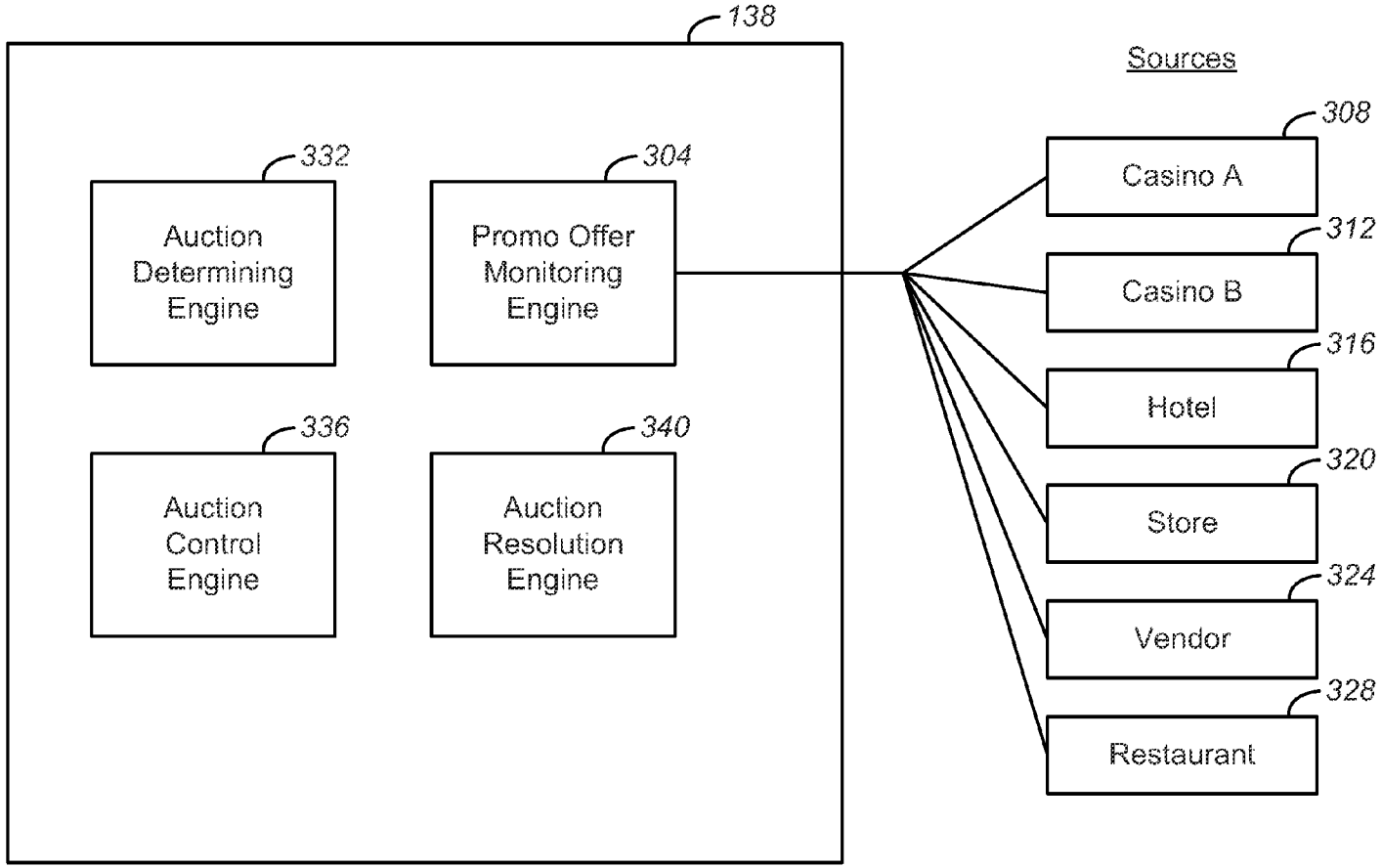
FIG. 3 shows a block diagram of an auction server 138, constructed in accordance with one embodiment of the present invention.

FIG. 3 shows a block diagram of an auction server 138, constructed according to one embodiment of the present invention. As mentioned above, auction server 138 can be constructed as a component or module of CRM server system 128 or as a stand-alone unit, depending on the desired implementation. In FIG. 3, auction server 138 includes a promotional offer monitoring engine 304 configured to monitor the distribution and status of promotional offers as part of a campaign. In one embodiment, promotional offer monitoring engine 304 is integral with CRM server system 128 to track the status of such promotional offers. FIG. 3 shoes a plurality of different examples of sources of promotional offers such as different casinos 308 and 312, a hotel 316, a store 320, an online or brick-and-mortar vendor 324, and a restaurant 328. Other various sources of promotional offers can be in communication with promotional offer monitoring engine 304 and/or CRM server 128 to notify such apparatus as to the issuance and, in some embodiments, redemption status, of such promotional offers. The promotional offer monitoring engine 304 includes processing apparatus configured to monitor and identify promotional offers associated with a campaign as having a redeemed or unredeemed status at any given point in time. In one embodiment, the promotional offers are associated with a CRM campaign carried out by CRM server system 128.

In FIG. 3, in one embodiment, the auction server 138 or components thereof, such as promotional offer monitoring engine, are constructed in hardware and supporting software as an add-on to a CRM system or as a separate server to track unredeemed offers. That is, auction server 138 could be a component of CRM or a dedicated server (standalone) or module/unit/processor that is self-contained. In either case, when the CRM system 128 gathers information regarding promotional offers and monitors their issuance, preferably auction server 138 is coupled to receive such information over a communications channel, e.g., of gaming network 104. In other alternative implementations, auction server 138 communicates with a third party database/system, e.g. Harrah's "Total Rewards" service, in place of CRM system 128, that maintains offer data for players.

Figure 6:
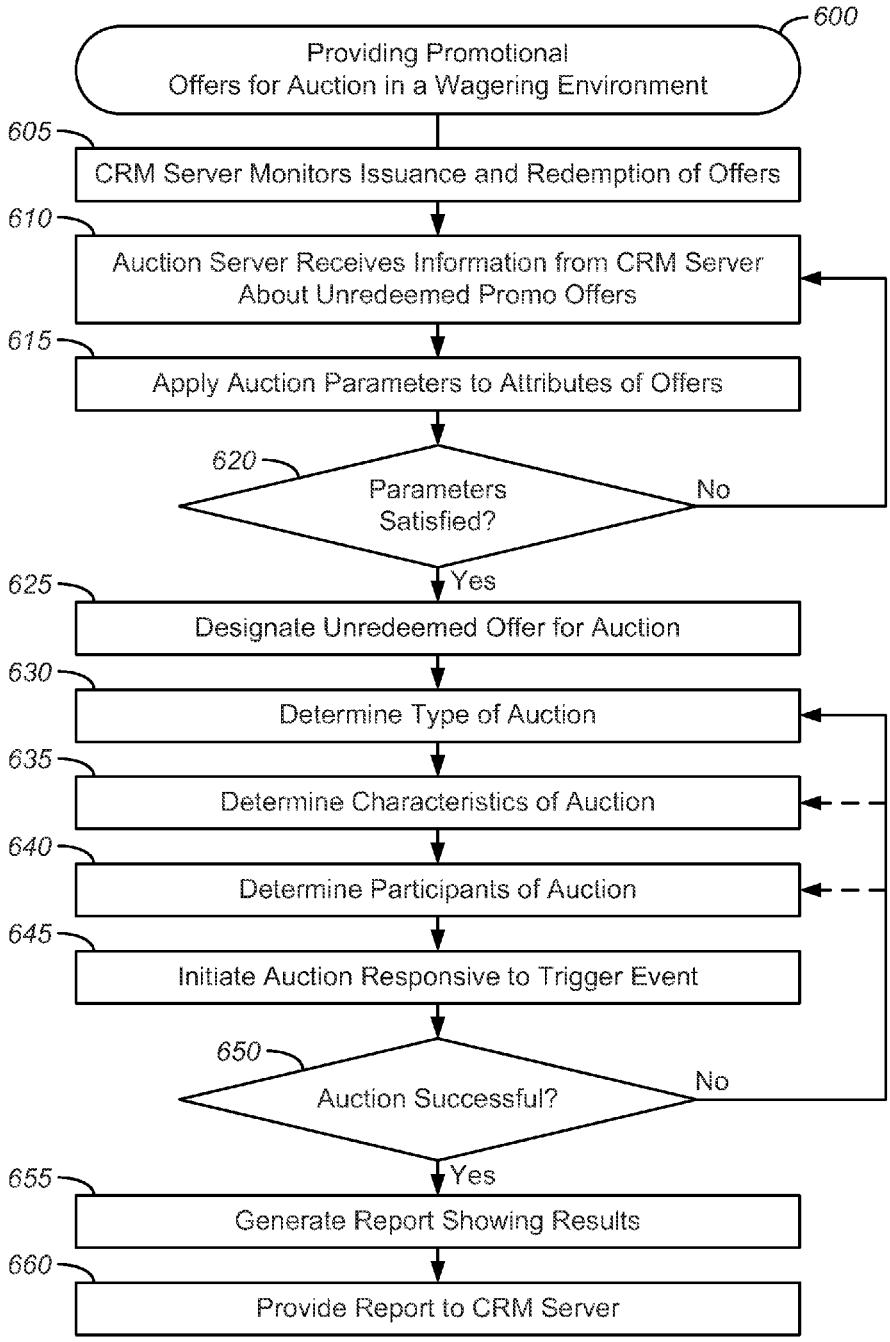
FIG. 6 shows a flow diagram of a method 600 for providing an auction of promotional offers in a wagering environment, performed in accordance with one embodiment of the present invention.

In FIG. 3, auction server 138 further includes an auction determining engine 332 configured to make one or more determinations regarding the promotional offers, as described herein particularly with reference to FIG. 6. Such determinations include, for example, determining that a promotional offer having an unredeemed status has one or more attributes satisfying certain parameters to designate the promotional offer for an auction.

In FIG. 3, auction server 138 further includes an auction control engine 336 including suitable data processing apparatus configured to initiate and control an auction for a promotional offer through the auctioning methods described herein. In one embodiment, the auction is carried out electronically, in which players at various gaming devices described above with reference to FIG. 1 can view, bid, and otherwise interact with the auction of promotional offers over graphical user interfaces generated and displayed on the various apparatus of FIG. 1. In one implementation, such electronic auctions include generation and display of virtual hosts, in the form of animated characters appearing in regions of displays presented to the players. Such animated characters can present auction-related information to the players, respond to player input, and otherwise interact with the players, as mentioned above. In another implementation, video images of live auction personnel are presented in place of, or in addition to, the animated characters, to provide similar information.

In FIG. 3, auction server 138 further includes an auction resolution engine 340 configured to handle the awarding and delivery of promotional offers to winning players as the auction is concluded. For example, auction resolution engine 340 may send a message to a gaming apparatus operated by a player to inform the player that he or she is the winner. Also, auction resolution engine 340 can be configured to instruct the gaming apparatus at which the winning player is located to print a receipt identifying the promotional offer and indicating where the player can retrieve the auctioned items. In another implementation, auction resolution engine 340 can send a message to auction host 160, informing the host as to the player's location in the gaming environment so that the host 160 can personally congratulate the player. In some implementations, the live host 160 can make arrangements for delivery of the won items. For example, when the items are easily portable and can be hand-carried, the live host or an assistant can physically deliver the items to the player at the player's location on the casino floor. In other situations where the player has won large and/or bulky items such as furniture, the host can instead make arrangements for shipping of the items to the player's home or preferred destination. In such instances, information including the player's preferred shipping address can be requested from and provided by the player before, during, or after the auction.

In one embodiment, auction resolution engine 340 is also configured to receive and handle payment for auctioned items. In addition to being capable of receiving payment in the form of cash, the auction resolution engine 340 can be configured to receive payment in a suitable pre-established form of credit (e.g., credit card, casino account, player tracking club points, etc.). In some embodiments, rewards with third-party providers, such as frequent flyer points with the player's selected airline, can also be used as credit. In such embodiments, the auction server 138 can provide clearinghouse services. For instance, the player could be allowed to exchange a designated number of the player's frequent flyer points for a show ticket. In this way, points and other promotional items from a variety of third parties can be normalized according to designated weights, and valued accordingly.

Figure 4:
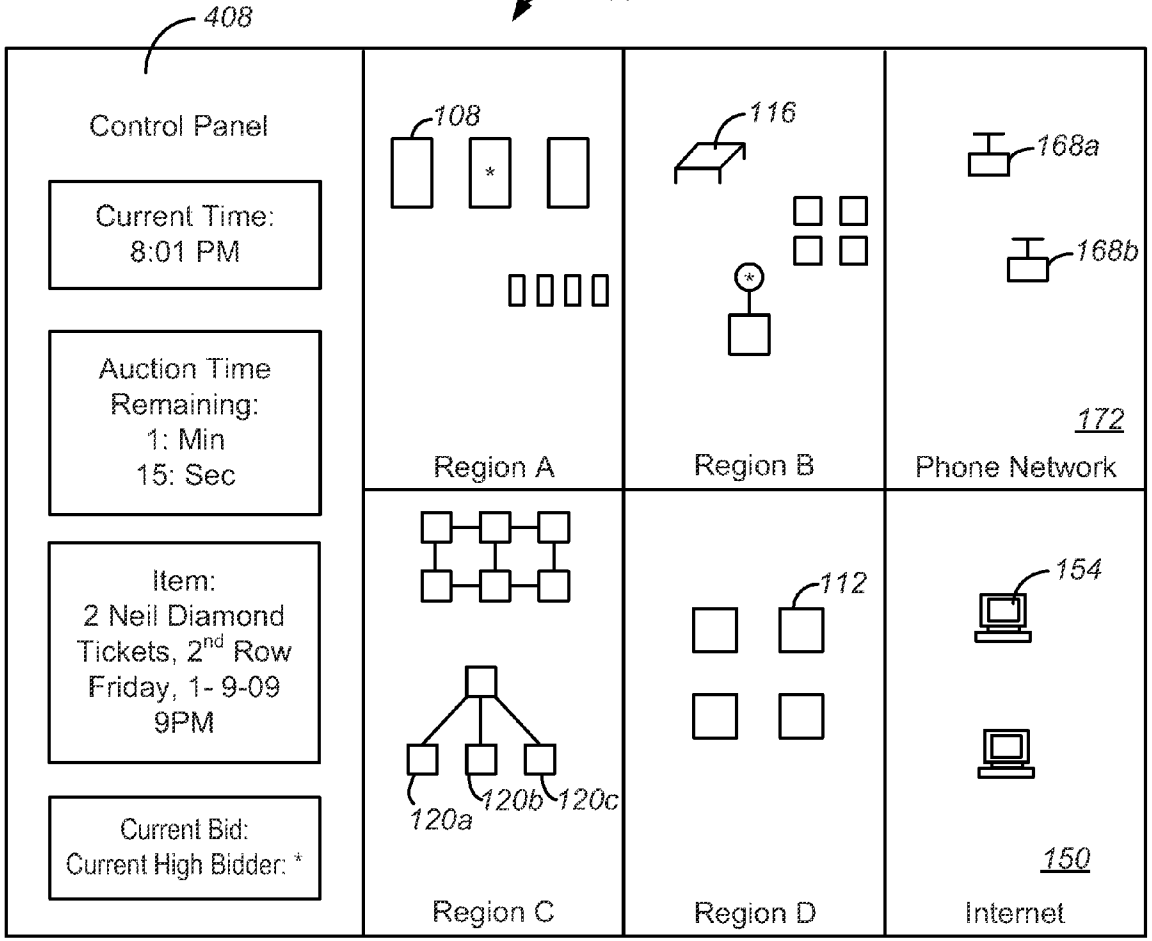
FIG. 4 shows an illustration of a graphical user interface 400 generated for display on a data processing device in accordance with one embodiment of the present invention.

FIG. 4 shows a graphical user interface 400 generated for display on a data processing device such as gaming machine 108, kiosk 112, table game processing apparatus 116, or personal computer 154. The graphical user interface (GUI) 400 can be displayed on the main display of a gaming machine, a peripheral display such as an information panel and, in some implementations, on a display of a player tracking device fitted in the machine. The player tracking display implementation can be beneficial to carry out auction methods and apparatus as described herein using older machines retrofitted with player tracking devices and services. The GUI 400 can be displayed in accordance with methods described herein, to provide a user with an image representing real-time auction and bidding activity in one or more gaming environments of a casino or multiple gaming properties. For instance, the GUI 400 outputs an illustration of a floor map of a gaming property with regions A-D identifying particular geographic areas within the gaming property. Within each region, wagering stations such as gaming machines, table games, bonus devices, and other apparatus are illustrated, as shown in FIG. 4. In implementations where such floor maps are displayed on gaming machines or other data processing apparatus operated by the players, such information can add to the excitement of the player's auction experience, for example, since the player can physically locate, observe, and communicate with other auction participants located in proximity to the player.

In addition, the GUI 400 of FIG. 4 shows auction and bidding activity occurring over phone network 172, illustrating phones 168*a* and 168*b* operated by auction participants located off-site, for instance, at home or in a hotel. Moreover, Internet activity is shown in a dedicated screen or region of GUI 400, in which the real-time bidding activity of various auction participants operating data processing devices 154 in conjunction with auction server 138 can be monitored. In a further region 408 of GUI 400, auction status and related information is displayed to the user, such as a casino operator or auction participant. In this control panel 408, a "time" field displays the current time, an "auction active" field indicates the time remaining in the auction, e.g. in the form of a countdown clock, and a field "item" shows one or more items currently up for auction that the players at the various devices can bid on. In one implementation, a count-up clock and related information is displayed for an auction, for example, showing the total number of units up for auction, the number of units sold, the length of time the units have been up for auction, a goal of a number of units to auction, and additional information to generate feelings of excitement and urgency in many players.

In FIG. 4, additional information assisting an auction host or auction operator can be displayed in GUI 400 including a symbol "*" displayed on a device at which a player has placed the current high bid in the auction. Thus, as the current high bid changes from player to player through the course of the auction, the symbol "*" moves about the GUI 400 to indicate the current location of the high bidder. In some embodiments, other bidders are similarly identified, such as the current low bidder, in-between bidders, and identifiable groups or alliances of bidders. Thus, the auction host 160, other auction personnel, or another auction participant can quickly identify and locate such players and personally contact them if desired.

In FIG. 4, the same or similar GUI 400 can be shown at the various devices described with reference to FIG. 1 where players participating in the auction may be located. In one embodiment, the countdown clock in control panel 408 is displayed on all applicable bidders' screens. In another embodiment, some auction participants are provided with additional time depending on their player's loyalty club status. That is, for instance, the higher the player status such as bronze, silver, gold, etc., the more time the player is provided to wager on the item. In some embodiments, the player's loyalty status is also a factor in determining which players are qualified to participate in an auction for a certain item or type of items, as described below with reference to FIG. 6, step 640. For example, the higher the player's status, that player is able to view and participate in auctions for more desirable and/or higher value promotional offers than players with a relatively lower status.

In FIG. 4, displaying the casino floor map to player participants fuels excitement. The players have a better idea of the live participants in the auction, and the auction may become more interesting when the players can see and communicate with one another on the gaming environment floor. In essence, the GUI 400 showing real-time bidding activity on a floor map provides positive and useful feedback by both an auction host, casino operator, and the player participants themselves.

Figure 5:
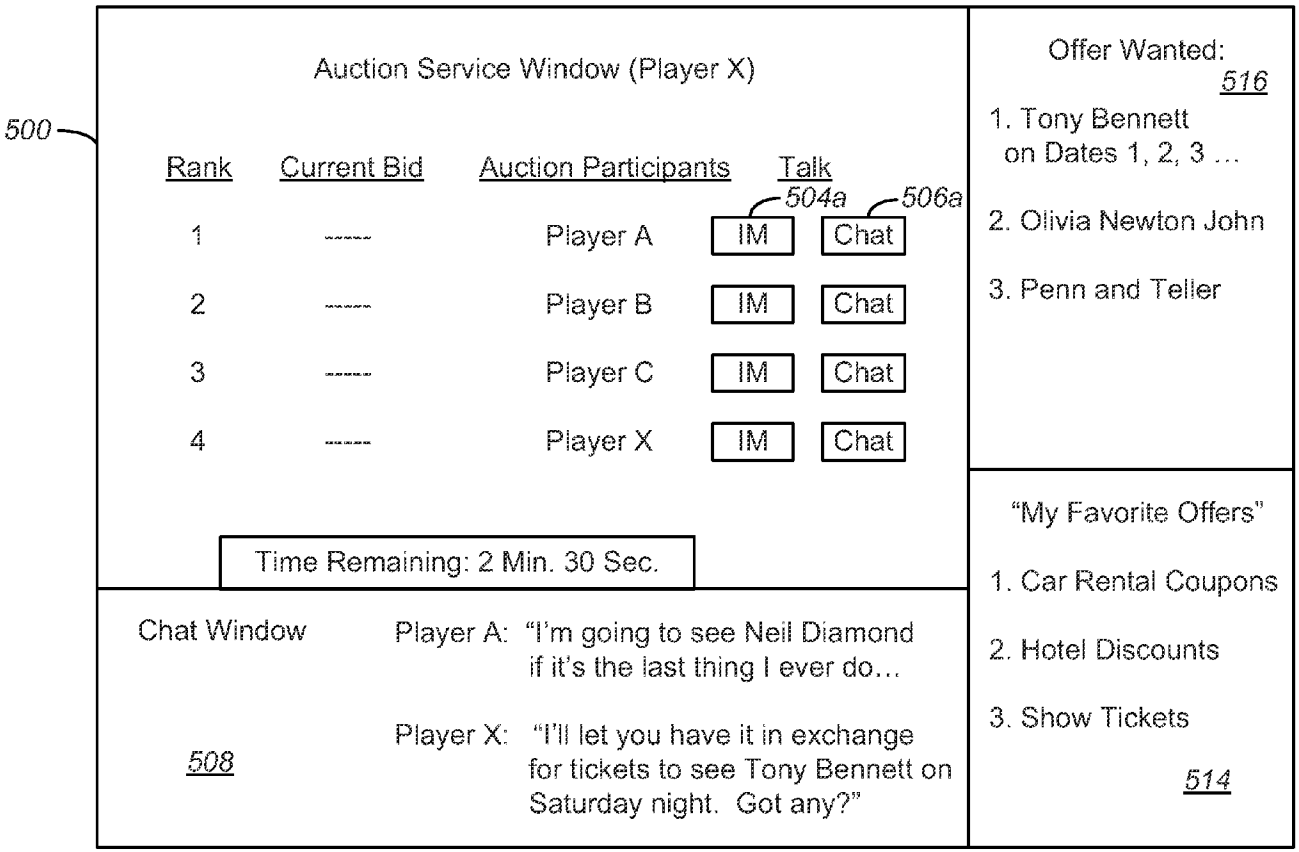
FIG. 5 shows an illustration of an auction service window 500 generated and displayed on one or more data processing devices in accordance with one embodiment of the present invention.

FIG. 5 shows an auction service window 500 generated and displayed on one or more data processing devices illustrated in FIG. 1, at which players participating in an auction may be located. The service window 500 may also be generated and displayed to casino personnel, for instance, at a back-end server or monitoring station. The service window 500, in one example, identifies all of the participants in an auction and, in one example, ranks the participants according to the current high bid. Thus, in FIG. 5, players A, B, and C are identified by name and ranked appropriately.

When used in conjunction with the GUI 400 described above, a player can more easily interact with other player participants of the auction. In one embodiment, as shown in FIG. 5, the player is provided with instant message "IM" and "chat" features allowing the player to communicate directly with other players participating in the auction. For instance, the player viewing the auction service window 500 may click or otherwise select an IM button 504*a* to send an instant message to player A, that will be received and displayed on a graphical user interface of the device at which player A is located. Player A can choose whether or not to respond to the message and by what means. In one embodiment, a chat feature 506*a* allows the player to open a "chat" window to have a real-time text conversation with the associated player in a region of service window 500 or a dedicated display. Such features add to the excitement, creating a more live and in-person experience of the auction in the gaming environment. Players can use the chat services to barter and strike deals with one another during or at the conclusion of an auction, as illustrated in chat window 508 of FIG. 5. In one embodiment, the messaging services can be used by casino personnel to deliver alert messages of upcoming promotional offers to bid on, bid status, general auction information, auction results, second-chance offers, and other information. In another embodiment, such information is relayed to identified player participants via email, on the player's cell phone, by mail, and by other means.

In FIG. 5, a "my favorite offers" window 514 indicates particular promotional offer items or types/categories of promotional offers that the player has indicated an interest in receiving. For instance, when the player is identified by inserting a player tracking card in the gaming device at which GUI 500 is displayed, a "my favorite offers" collection of data stored at the CRM server or player tracking server can be retrieved and displayed to the player as part of the GUI 500. To this end, player preferences can be entered at any gaming machine at which the player has been identified, and then stored at a back-end storage medium. In other embodiments, promotional offers to include as "my favorite offers" are automatically selected by auction server 138 based on player tracking information stored for that player. That is, player likes and dislikes can be gathered and abstracted from such information. Thus, promotional offers such as shopping coupons at particular stores, sports tickets, lounge acts, free drinks or meals, and other items of particular interest to the player can be maintained. In this way, the CRM system 128 can be adapted to recognize such desired offers by the player and ensure that unredeemed promotional offers satisfying that criteria can be made available to that player. That is, the player can be included or excluded as a participant in the auction for those promotional offers based on the criteria. In one example, using player loyalty status as a factor, bronze level players may be excluded from an auction for only silver or gold level players.

In FIG. 5, an "offers wanted" field 516 shows particular promotional offers which the player has expressly requested to receive when available for auction, for instance, "looking for two Tony Bennett show tickets for Friday night . . . ," or "any women's clothing discount coupons?" Thus, auction server 138 can directly respond to player requests for particular auction items and better satisfy the player's direct wishes as well as satisfy the casino and source of the promotional offer by exposing the offer to those players most likely to buy them.

FIG. 6 shows a flow diagram of a method 600 for providing an auction of promotional offers in a wagering environment, performed in accordance with one embodiment of the present invention. The method 600 begins in step 605, in which a CRM server or servers 128 monitors issuance and redemption of promotional offers provided by various sources, as described above. In one embodiment, this monitoring is performed by promotional offer monitoring engine 304 of auction server 138, as described above with reference to FIG. 3. Regardless of where the monitoring is performed, the monitoring includes identifying a source of the promotional offer and a type of promotional offer, such as show tickets, free meal coupons, hotel, discounts, etc. In addition, the monitoring includes identifying a particular event of the promotional offer, such as Tony Bennett on Saturday night, at 7:00 pm, at the MGM Grand. The monitoring also includes tracking a number of promotional offers issued, and the number of those issued promotional offers that have been redeemed by patrons at any given time. In one embodiment, step 605 represents a continuous monitoring process in which the count of offers issued and status of offers as unredeemed/redeemed is updated as the status of those offers develops over time.

In FIG. 6, at some point, in step 610, information regarding promotional offers having an unredeemed status is received from CRM system 128 or directly from promotional offer monitoring engine 304. In step 610, in one embodiment, when CRM system 128 is responsible for monitoring issuance and redemption of offers, such information is communicated to auction server 138 at regular intervals or at designated instances of time. In this way, in step 615 of method 600, auction server 138 can apply one or more auction parameters to attributes associated with the unredeemed offers. When one or more attributes associated with the unredeemed promotional offer satisfies such parameters, auction determining engine 332 of auction server 138 designates the unredeemed promotional offer for an auction.

In step 615, the parameters can include a variety of factors, such as the reaching of a minimum amount of time before the event associated the promotional offer occurs. For instance, in the case of a show, when the show will begin in less than a certain number of hours, such as five hours, auction determining engine 332 can initiate an auction for the promotional offer, due to the time-sensitive nature of the event associated with the offer. Another parameter which can be accounted for, in step 615, is an expiration time for the promotional offer. For instance, if the promotional offer will expire in less than a certain amount of time, the auction server 138 can essentially determine that the offer is again of a time-sensitive nature, and factor this into the determination of whether to initiate an auction of the promotional offer.

In step 615, a number of additional parameters can be taken into account by determining engine 332 in accordance with embodiments of the present invention, such as a day, time, month, or season associated with the promotional offer. Another parameter can be a special status of an event, for instance, a show or race. That is, special promotional offers connected with the special event can be provided for auction at designated times before the event, to increase excitement and attendance at the event. Such a special event can be provided, in some implementations, by a third party working in collaboration with the casino, which manages distribution of the promotional offers. In one implementation, as mentioned above, the CRM server 128 preferably keeps track of the total number of promotional offers for a particular event or category of events, as well as the total number of those offers which have been redeemed. Thus, using such information, auction determining engine 332 can determine that when the total number of unredeemed promotional offers exceeds some threshold or, in another example, when the percentage of issued and unredeemed promotional offers exceeds a threshold, such a determination weighs in favor of initiating an auction for the promotional offer.

In FIG. 6, in step 615, the parameters for designating a promotional offer for auction can also include a value of the promotional offer. In certain instances, the price of the ticket or amount of a discount can be high enough that the casino or source of the promotional offer determines that the offer should be auctioned sooner rather than later. Thus, when the value of the promotional offer exceeds some threshold, the determining engine 332 can signal that an auction for the promotional offer should be initiated.

In step 615, another parameter that can be considered in the determination of whether to initiate an auction for an unredeemed promotional offer is the source of the promotional offer. For instance, when the source of the offer is the casino itself or a business having a special relationship with the casino or auctioneer, such offers provided by that source can be designated as having a priority auction status. In other words, in one example, when a similar unredeemed promotional offer provided by another source may have attributes not yet satisfying the parameters acquired to initiate an auction, when the source of the offer has such a special status, such a factor can weigh in favor of going ahead and initiating the auction.

Figure 7:
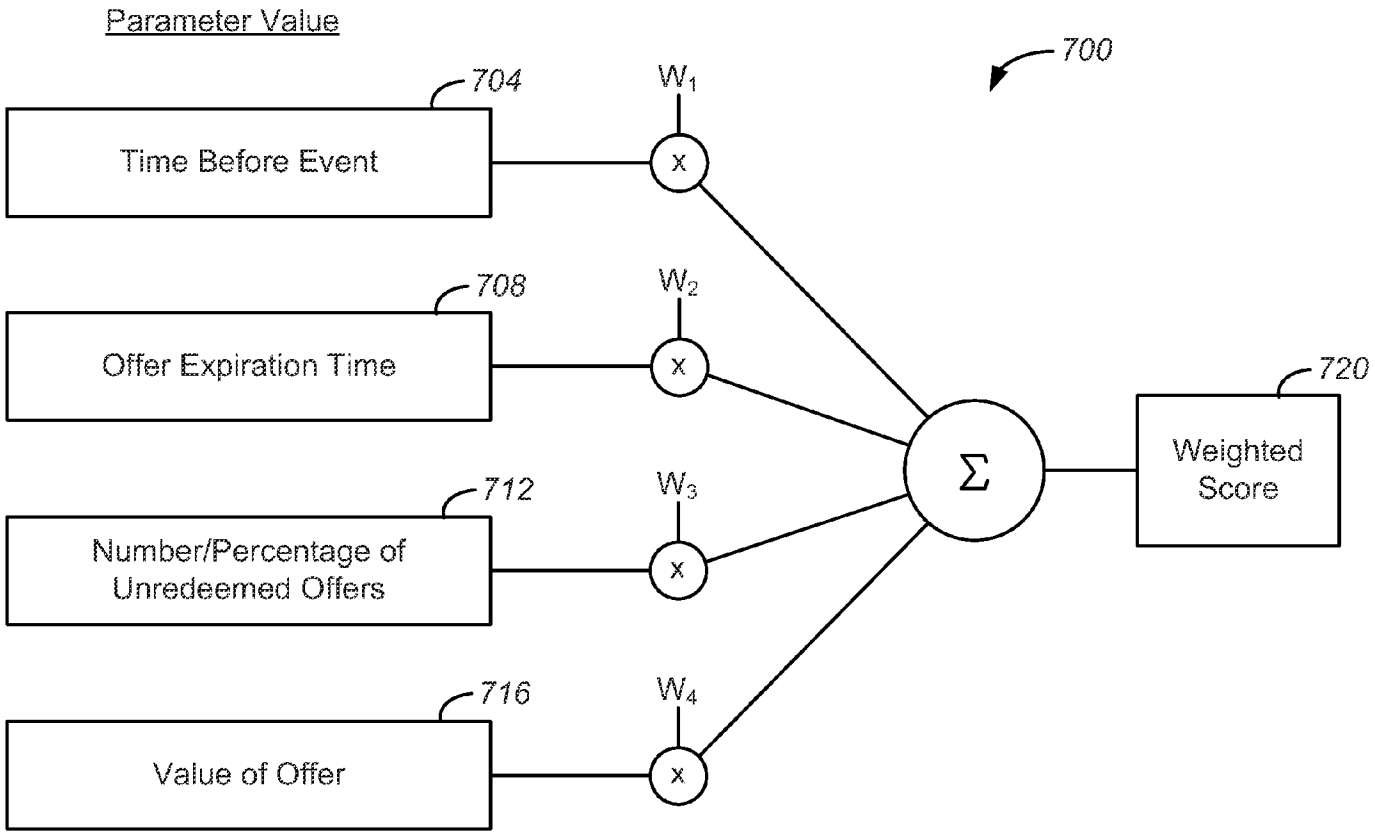
FIG. 7 shows an illustration of a method of applying weights to parameter calculations for determining a score, performed in accordance with one embodiment of the present invention.

As mentioned above, a number of attributes associated with an unredeemed promotional offer can be considered, and various parameters can be defined to apply to those attributes and make an ultimate determination as to whether to initiate an auction for the promotional offer. In one embodiment, a weighted combination of the application of one or more parameters to corresponding attributes of the promotional offer is performed to calculate a score, which is then compared with a threshold value to make the determination as to whether to initiate a promotional offer. As shown in FIG. 7, elements 704-716 individually represent the application of a separate parameter to one or more attributes of the unredeemed promotional offer. For instance, as shown in FIG. 7, the time before a particular event which the unredeemed offer is promoting has been calculated in step 704. Another factor, the time remaining before the promotional offer expires has been calculated in step 708. In step 712, the number or percentage of unredeemed promotional offers has been calculated, as described above. In step 716, the factor of the value of the promotional offer is also taken into account. Other parameters such as those described above, particularly including those parameters which have numerical values or can be represented in a numerical manner are also factored into account in the weighted calculation 700 of FIG. 7.

In FIG. 7, in one embodiment, respective weights W1, W2, W3, and W4 are applied to the respective calculations 704, 708, 712, and 716, and any other parameters desired to be taken into account. These weights W1, W2, W3, and W4 can be determined based on experience, for example, the observation and importance placed on the parameter calculations 704, 708, 712, and 716 in past auctions. An operator can observe the effect of individual parameter calculations on the determination of whether to initiate an auction for the item and adjust weights accordingly. In another example, the weights can be automatically adjusted depending on a ranking or relative importance placed on individual parameters by a casino or auction operator.

In FIG. 7, when the respective weights W1, W2, W3, and W4 are applied to the respective parameter calculations 704, 708, 712, and 716, the sum of the weighted parameter calculations is calculated to determine a score 720. This score can then be observed by the auction or casino operator, or compared with a threshold amount, to make a more global determination of whether to initiate the auction for the item. The threshold amount with which the score is compared can also be set and adjusted over time based on the goals of a casino or auction operator.

Returning to FIG. 6, in step 620, the determining engine 332 of auction server 138 determines whether the attributes associated with the unredeemed promotional offers satisfy the one or more auction parameters described above. For example, in one implementation, a single time parameter is checked. That is, when it is determined that the time remaining before an event begins is less than a threshold, auction control engine 336 initiates an auction for the item. Various combinations of parameters described herein can be used in making the determination of step 620, including the weighted scoring method 700 described above. When the one or more parameters are satisfied, for instance, when the weighted combination of parameter calculations of FIG. 7 exceeds or satisfies a requisite score, the method 600 proceeds to step 625, described below.

In instances when the one or more auction parameters are not satisfied, the method returns to step 605 to continue monitoring and gathering status information regarding the unredeemed promotional offers. Thus, the method can again proceed to apply parameters to various attributes as those attributes change over time, in step 615. The repeated application of parameters to the various attributes can be performed at periodic intervals, as designated by a controller or operator, or at other times deemed appropriate for checking whether unredeemed offers should be auctioned. In one implementation, auction parameters are applied to any unredeemed offers at a certain time in the day deemed likely to gather auction participants and be an exciting time for an auction, for instance, at 7:00 pm weekday evenings and 10:00 pm on weekends.

In FIG. 6, when auction determining engine 332 of auction server 138 determines that one or more attributes satisfy the auction parameters, the method proceeds to step 625, in which auction server 138 designates such unredeemed offers for auction. The method then proceeds to steps 630, 635, and 640, of FIG. 6, in which various characteristics of the auction are determined and set by auction control engine 336 of auction server 138. These and other characteristics can be determined in any order, as desired for the particular implementation. In one example, in step 630, auction control engine 336 determines a type of auction to hold for the particular unredeemed promotional offers. Such a determination can be based on operator preference or automatically determined based on one or more of the various attributes of the unredeemed promotional offer, described herein.

In FIG. 6, following step 630, the method proceeds to step 635 in which one or more additional auction characteristics are determined, to attempt to structure the auction so that it yields distribution of the unredeemed promotional offer for a desirably high bid for the casino operator and in a desirably exciting manner for the auction participants. Such determinations can be based on historical data showing high bids for similar types of promotional offers and other information such as player or auction surveys, showing the types of auctions preferred by players. In step 635, such additional characteristics include time, bid increment, participation of a live auction host, graphical displays of information and images on the various devices used by players to participate in the auction, and the manner in which promotional offers are displayed and delivered to players upon winning the auction. Other various auction characteristics associated with the types of auctions described herein and otherwise known can be determined and set accordingly, in step 635. In one embodiment, a casino could have a continuous auction taking place for certain offers and a spontaneous auction when they need to move time-sensitive offers. "Buy it now" offers can also be made available.

In FIG. 6, the method proceeds to step 640, in which auction participants are identified to participate in the auction for the particular unredeemed promotional offers. In one embodiment, step 640 is repeated, with the auction participant pool being re-defined, for example, to broaden the participant pool as auctioning determining engine 332 determines over time that it is more critical and/or time-sensitive that the promotional offers be auctioned immediately. Such may be the case, for example, when the unredeemed promotional offers are tickets to a show, and there is a shorter amount of time until the show begins. Other parameters described herein can affect the importance or time-sensitive nature of auctioning an item immediately. Thus, in step 640, depending on how far exceeded the various parameters are, as described above, or in one example, as the weighted sum of numerical parameter calculations increasingly exceeds a threshold score, the pool of players/auction participants can be broadened accordingly.

In FIG. 6, in step 640, various information can be used to select and define a group of auction participants, including: CRM information/data, player tracking information, player loyalty club status, gaming machine identification information at which players are located, other device information identifying devices at which players are located, geographic location information for possible players and participants, and demographic information associated with one or more potential participants. For instance, certain demographics may indicate whether a player is more or less likely to be interested in the promotional offers up for auction. In one embodiment, by leveraging player tracking information already gathered in the player tracking database, unique offers can be targeted to specific players.

In FIG. 6, in step 640, as the auction of the particular unredeemed promotional offers becomes more time-sensitive, for example, as the event draws nearer, a pool of player and auction participants is broadened accordingly, to attempt to successfully auction the items in a timely manner. In one embodiment, for example, when an item first goes up for auction, a preferred group of players, such as those having a "gold" status in a casino loyalty program, may be the initial group selected to participate in the auction. In this way, such preferred status players obtain yet another benefit of having such a status by being the first select group to bid on an item. Over time, if the same item is not auctioned successfully, the pool can be enlarged by adding players having other loyalty club status levels (e.g., silver, bronze, etc.), and adding players meeting any of a variety of additional criteria, such as players having player tracking information meeting certain parameters, players having demographic information meeting certain parameters, and players in a desirable geographic range of the casino at which the item is being auctioned. In one example, as the event associated with a promotional offer draws increasingly near, or some other parameter value of the item indicates a need to auction the item immediately, the player pool can be enlarged to include any and all players identifiable as located within a casino and, in some instances, players located in other properties and at locations such as at home or work using a personal computer 154, as shown in FIG. 1. In some embodiments, such a large pool of auction participants can be defined from the outset, to provide maximum participants and thereby likely increase the ultimate high bid, providing maximum value to the casino.

Some embodiments of the present invention include a subscription service, in which existing and potential auction participants can subscribe and be notified of upcoming casino or third-party promotional offers. In some implementations, the subscription is complimentary, for instance, when a player registers for a player tracking program or stays in a hotel affiliated with the casino. In other implementations, players can sign up and pay a fee for the service. In one embodiment, a tiered pricing structure, based on the player's loyalty club status, is contemplated for the subscription service. For example, such a pricing structure could include three tiers, with pricing at $79 per year for gold player tracking club members, $89 per year for silver members, and $99 per year for bronze members.

In some embodiments of the above-described subscription service, the number and/or value of promotional offers made available to subscribers is determined according to the player's loyalty club status. Continuing with the example of the gold, silver, and bronze tiers, the number of offers made available to players in the respective levels can be tiered accordingly, e.g., gold players are provided with approximately 100 offers per year, silver players receive approximately 70 offers per year, and bronze players receive approximately 50 offers per year. When such a player/potential auction participant is to be offered to participate in an auction for the designated items, a message notifying the player/potential auction participant can be sent from the auction server 138 of FIG. 1 to the player by various communications channels, including mail, email, instant messaging, website, blog posting, automated call to cell phone, and other various forms.

In FIG. 6, after the various characteristics of the auction are determined and the participants are identified, the auction can be initiated, in step 645. In one embodiment, the auction is initiated immediately upon determining characteristics and identifying the pool of participants. In another embodiment, a separate trigger event can be structured so that the auction is not initiated until such event occurs. For instance, in one embodiment, regardless of how many parameters are satisfied or how far the score of the weighted combination of calculated parameter values exceeds a threshold, the casino operator or auction host may determine that the auction will not be initiated until the occurrence of a separate trigger event, e.g., reaching a certain time before an event associated with the promotional offer begins.

During the auction, various auction characteristics can be set and adjusted accordingly, for instance, with flashing lights, audio messages or sound effects output from speakers on the machines and/or speakers in proximity to designated machines, announcements, and other activity by an auction host to incite enthusiasm and excitement in players. The auction host can function as a cheerleader or in other ways to encourage players to participate and bid liberally on items up for auction. Examples of auction trigger events, in step 645, include occurrence of a bonus event, a game play event, and identification of a time preceding the event as within a certain threshold.

In some embodiments, often the triggering event or designation of an item for an auction is made independent of real-time game play. That is, the triggering event occurs independent of outcomes or other events as part of wager-based game play by a player on the machine or other gaming device. For instance, the triggering event can be a mystery auction, e.g., a mystery as to the time or a time period during which the auction is initiated. In one example, the mystery auction is made available to players having only a certain loyalty club status, such as gold level. In other examples, the triggering event can be an amount of coin-in, an amount of credit-in, bet size, bet speed, season, month, and/or time of day. Additional examples of triggering events include a type of game, e.g., progressive gaming, penny games, the type of gaming device operated by the player, such as a gaming machine, a PDA, or a cell phone, and the player's loyalty club status.

Returning to step 640, additional information that can be used to identify auction participants includes express request messages from one or more participants. For instance, a player having a "my favorite offers" window on a graphical user interface 500, as described herein, may be provided with identification of an unredeemed promotional offer as being considered for auction. Responsive to viewing such an item, the player can send a message from the device at which the player is located to the auction server, requesting to participate in such auction when the item goes up. Player requests for particular items can be received over various communication mediums and at various stages of activity, including being noted when the player signs up for a player tracking program, or when the player fills out a survey or questionnaire when participating in casino activity or other related services.

In one embodiment, a player's "my favorite offers" can be automatically determined based on information gathered for the player, such as player preference data, e.g., Player X likes jewelry, beer as a beverage, perfume, and other items of interest. Additional player tracking club information can be leveraged to identify promotional offers for auction to that player.

In FIG. 6, in step 645, when the auction is initiated, auction control engine 336 controls the flow of events in the auction. In one embodiment, the live auction host 160 can control the events and report such information to auction control engine 336. In one embodiment, it is contemplated that a sharing of control of the flow of the auction occurs between live auction host 160 and auction control engine 336. As part of the auction, players participating in the auction are desirably provided with graphical user interfaces on devices operated by those participants, to provide the players with real-time auction information and related information, such as described above with reference to FIGS. 4 and 5, and graphical bidding mechanisms. Various devices can be operated by the player to participate in an auction, including gaming machines, video displays situated at table games, kiosks, portable hand held devices, and computers. In one embodiment, an auction of a promotional offer is recorded on a suitable video and audio recording medium, so the player can watch a replay of the auction. A digital copy of the recording can be delivered to the player as an attachment to an email, as a recording on a CD or DVD, or downloaded from a server accessible over the Internet.

In FIG. 6, after an auction is initiated by auction control engine 336 in step 645, the method proceeds to step 650. In this step, when the promotional offer is successfully auctioned, the method proceeds to step 655, wherein auction resolution engine 340 handles the conclusion of the auction. In step 650, when an item is not successfully auctioned for one reason or another, for instance, after passage of a certain amount of time, the method 600 returns to one or more of steps 630, 635, and 640, in which the auction can be restructured to more aggressively auction the promotional offers at issue, as described above. For instance, the group of participants invited to participate in the auction can be broadened to include players in a wider variety of locations, such as players operating computers coupled to the Internet, players located in hotel rooms, or even with no regard to geographical location. Also, in one embodiment, a player can sign up for a "bidding tournament," similar to a slot tournament, where single players or groups of players compete for offers within a specified time period. Such a bidding tournament can be initiated when an item has not been successfully auctioned or from the outset to more aggressively auction certain items.

In FIG. 6, in step 655, the auctioned promotional offer or offers are delivered to the winning bidders. In one embodiment, a report detailing the results of the auction, such as the particular promotional offers at issue, the winning bid amounts, the location of the winning bidders, the location of other bidders, and other such information can be generated. Promotional offer status and inventory data is desirably updated in real-time as items are auctioned. This report, in one embodiment, is also provided to CRM server 128, in step 660, so that the status of the promotional offers can be reconciled. In addition, the providing of such information to CRM server 128 allows the server to update player information maintained at CRM server 128 and/or player tracking server 132. In this way, such information can be used to better tailor future auctions, for instance, by selecting a more appropriate pool of auction participants and defining the auction and auction characteristics in a manner most likely to maximize casino profit and provide maximum enjoyment to players interested in those types of items. Such information can be stored at a storage medium or database associated with CRM server system 128 for later retrieval.

In another embodiment, auction-related information displayed on various displays, as described herein, for instance, in the form of GUI 400, can also be displayed on large screen video displays or televisions displayed about a casino floor. In this way, the information can be displayed in the manner of a video billboard, so the information can be shown to larger numbers of individuals on a gaming environment floor, inciting interest and enthusiasm for those individuals to participate in future auctions. For example, information described above with reference to GUI 400 can be broadcast in this manner to anyone within viewing range of the large-screen video display. Such information can further include graphs and charts of the auction data. Such displays can also display third party advertisements, to provide an additional advertising revenue source.

In one embodiment, player bids are tracked by auction control engine 336 to provide real-time feedback for adjustments or refinements to auction characteristics. In one embodiment, such information is stored as a portion of CRM data. Historical auction data maybe analyzed to characterize the behavior of an auction, such as the average period of time between bids and the average increment between bids. Rules may be generated to correspond to such behavior characterizations.

In one embodiment, another novel aspect of the auction of promotional offers as disclosed herein is the offering or providing of a further promotional offer with the promotional offer to be auctioned. That is, either known or unknown to the player participants, the unredeemed promotional offer being bid upon can include an embedded promotional offer that may be, for example, related to the type of offer being bid upon. Such an embedded offer can be sourced from the casino or a third-party. In one example, an unredeemed promotional offer is free tickets to see Barry Manilow on Friday night. When the tickets are delivered to the winning bidder, the bidder is also awarded with tickets or a coupon discount to see a Neil Diamond show the following evening. Such events can be offered at different properties, such as different casinos, and through collaborative efforts of different operators at various venues.

Communications among the various participants described herein can be carried out by various mechanisms, in accordance with embodiments of the present invention. Such communications mechanisms include, for example, regular mail, email, instant messaging, website announcements or notifications, blog postings, automated calls to cell phones, and other similar services. Depending on the desired implementation, any one or more of such mechanisms can be used to deliver any notifications and information between parties, as disclosed herein. Thus, such mechanisms can be used for communication from casino to player, player to casino, casino A to casino B, third-party provider to player, player to third-party provider, third-party A to third-party B, casino to third-party, third-party to casino, and player A to player B. In one embodiment, a "casino auction blog" maintained on a web server would provide a data repository for posting of assessments and recommendations of the offers by players and potential players.

Returning to step 630 of FIG. 6, various types of auctions can be performed, and can be adapted to suit the auctioning of promotional offers. In one example, participants bid openly against one another, with each bid being higher than the previous bid. The auction ends when no participant is willing to bid further, or when a pre-determined price is reached, at which point the highest bidder pays the price. In another example, the seller may set a reserve price, and if the auction fails to have a bid equal to or higher than the reserve, the item remains unsold. Another example is a no-reserve auction with no minimum bid amount, no set starting bid, no seller confirmation of a high bid price, and no buybacks of promotional offers being offered by the seller or any agents of the seller. The highest bidder will purchase the property no matter the high bid price.

Other examples include Dutch auctions, beginning with a high asking price which is lowered until some participant is willing to accept the auctioneer's price, or a predetermined minimum price is reached. That winning participant pays the last announced price. In a combinatorial auction, bidders can place bids on combinations of items, or "packages," rather than individual items. Further examples of auctions which can be used with embodiments of the present invention are reverse auctions, unique bid auctions buy-out auctions, and private auctions in which the identities of the bidders hidden, so anyone that buys the item can remain anonymous. This is normally done for either security reasons such as rare gems or art, or to avoid embarrassment. Additional examples of auctions defined and implemented with embodiments of the present invention include sealed auctions, as well as double auctions, in which both sellers and buyers submit bids that are then ranked highest to lowest. This format allows buyers to make offers and sellers to accept those offers at any particular moment.

Gaming machine hardware and software, server and other data processing hardware and software, and supporting network architecture and infrastructure, is described in LeMay et al., U.S. patent application Ser. No. 11/595,774, titled "METHOD AND APPARATUS FOR INTEGRATING REMOTELY-HOSTED AND LOCALLY RENDERED CONTENT ON A GAMING DEVICE," filed Nov. 10, 2006, which is hereby incorporated by reference in its entirety for all purposes. Such hardware, software and network resources can be implemented to support the various inventive methods, apparatus, and systems disclosed herein.

Although the foregoing present invention has been described in detail by way of illustration and example for purposes of clarity and understanding, it will be recognized that the above described present invention may be embodied in numerous other specific variations and embodiments without departing from the spirit or essential characteristics of the present invention. Certain changes and modifications may be practiced, and it is understood that the present invention is not to be limited by the foregoing details, but rather is to be defined by the scope of the appended claims.

The invention is claimed as follows:

1. A data processing apparatus comprising:

at least one processor; and at least one memory device storing a plurality of instructions which, when executed by the at least one processor, cause the at least one processor to:

(a) receive an identification of a promotional offer having an unredeemed status;

(b) determine, based at least in part on at least one attribute of the identified promotional offer, whether the identified promotional offer satisfies at least one parameter, the at least one parameter being independent of any plays of any wagering games;

(c) if the identified promotional offer satisfies the at least one parameter, designate the identified promotional offer for an auction; and (d) provide the designated promotional offer as an item to be auctioned.

2. The data processing apparatus of claim 1, wherein the at least one parameter includes a time before an event associated with the promotional offer.

3. The data processing apparatus of claim 1, wherein the at least one parameter includes a status of an event associated with the promotional offer.

4. The data processing apparatus of claim 1, wherein the at least one parameter includes an expiration time for the promotional offer.

5. The data processing apparatus of claim 1, wherein the at least one parameter includes one of a number of issued promotional offers having the unredeemed status and a percentage of issued promotional offers having the unredeemed status.

6. The data processing apparatus of claim 1, wherein the at least one parameter includes a value of the promotional offer.

7. The data processing apparatus of claim 1, wherein the at least one parameter includes an identification of a source of the promotional offer.

8. The data processing apparatus of claim 7, wherein the source includes one selected from the group consisting of: a casino operator, a third party provider, and a collaboration of the casino operator and the third party provider.

9. The data processing apparatus of claim 1, wherein the at least one parameter includes a plurality of parameters, and the plurality of instructions, when executed by the at least one processor, cause the at least one processor to determine that the identified promotional offer satisfies the plurality of parameters by calculating a weighted combination of the satisfied plurality of parameters.

10. The data processing apparatus of claim 1, wherein the plurality of instructions, when executed by the at least one processor, cause the at least one processor to identify one or more participants for the auction based on information associated with the one or more participants.

11. A system comprising:

(a) a customer relationship management server configured to:

(i) maintain customer relationship management data for a plurality of players participating in a customer relationship management program; and (ii) monitor a status of each of a plurality of promotional offers; and (b) a data processing apparatus configured to:

(i) receive, from the customer relationship management server, an identification of one or more of the promotional offers having an unredeemed status; and (ii) for each of the identified one or more of the promotional offers:

(A) determine, based at least in part on at least one attribute of said identified promotional offer, whether said identified promotional offer satisfies at least one parameter, the at least one parameter being independent of any plays of any wagering games; and (B) if said identified promotional offer satisfies the at least one parameter, designate said identified promotional offer for an auction and provide the designated promotional offer as an item to be auctioned.

12. The system of claim 11, wherein the data processing apparatus is further configured to generate a report including data indicating results of the auction and sending said report to the customer relationship management server.

13. The system of claim 11, which includes a device including:

(a) at least one processor;

(b) at least one display device; and (c) at least one memory device storing a plurality of instructions which, when executed by the at least one processor, cause the at least one processor to operate with the at least one display device to generate and display a graphical indication of wagering stations on a floor map of a gaming environment.

14. The system of claim 13, wherein the graphical indication includes information identifying bidding activity at the wagering stations.

15. The system of claim 11, which includes a device configured to generate a graphical user interface for participation in an auction.

16. A method comprising:

(a) causing at least one processor to execute a plurality of instructions stored in at least one memory device to receive an identification of a promotional offer having an unredeemed status;

(b) causing the at least one processor to execute the plurality of instructions to determine, based at least in part on at least one attribute of the identified promotional offer, whether the identified promotional offer satisfies at least one parameter, the at least one parameter being independent of any plays of any wagering games;

(c) if the identified promotional offer satisfies the at least one parameter, causing the at least one processor to execute the plurality of instructions to designate the identified promotional offer for an auction; and (d) providing the designated promotional offer as an item to be auctioned.

17. The method of claim 16, which includes causing the at least one processor to execute the plurality of instructions to initiate an auction for the designated promotional offer upon occurrence of an auction trigger event.

18. The method of claim 17, wherein the auction trigger event occurs upon one selected from the group consisting of: an occurrence of a bonus event, an occurrence of a game play event, and an identification of a time preceding a promotional event as being within a threshold.

19. The method of claim 16, wherein the at least one parameter includes a plurality of parameters, and causing the at least one processor to execute the plurality of instructions to determine whether the identified promotional offer satisfies the one or more parameters includes causing the at least one processor to execute the plurality of instructions to calculate a weighted combination of the satisfied plurality of parameters.

20. The method of claim 16, which includes:

causing the at least one processor to execute the plurality of instructions to generate a report including auction results information; and providing the report to a database storing customer relationship management information.

* * * * *